US005195224A

United States Patent [19]

Bock et al.

[11] Patent Number: 5,195,224

[45] Date of Patent: Mar. 23, 1993

[54] SHOCK-PROOF SAFETY BELT BUCKLE

[75] Inventors: Andreas Bock, Pinneberg; Alfred Liensdorf, Norderstedt; Peter Eckmann, Hamburg, all of Fed. Rep. of Germany

[73] Assignee: Autoflug GmbH & Co. Fahrzeugtechnik, Rellingen, Fed. Rep. of Germany

[21] Appl. No.: 874,798

[22] Filed: Apr. 3, 1992

[51] Int. Cl.[5] ..... A44B 11/26

[52] U.S. Cl. ..... 24/641; 24/633

[58] Field of Search ..... 24/633, 636, 637, 640, 24/641, 645, 651; 297/468

[56] References Cited

U.S. PATENT DOCUMENTS 5,008,989 4/1991 Wedler et al. ..... 24/633 X

FOREIGN PATENT DOCUMENTS 3533684 2/1987 Fed. Rep. of Germany .

*Primary Examiner*—James R. Brittain

*Attorney, Agent, or Firm*—Robert W. Becker & Associates

[57] ABSTRACT

A safety belt buckle comprises a housing with an insertion path, a spring loaded ejector positioned in the insertion path, and a recess communicating with the insertion path. An insertion tongue with a cutout is insertable into the insertion path. A latch inside the housing locks the insertion tongue by engaging the cutout of the insertion tongue and the recess of the housing. A spring-loaded slide key is slidably connected to the housing and slidable in the direction transverse to a plane of movement of the latch. A spring-loaded slide key serves to release the latch. A compensation mass member is displaceably arranged within the housing for compensating acceleration forces acting on the safety belt buckle. A securing element is displaceably arranged within the housing such that the securing element secures the latch in its locking position and is movable into a release position by the slide key. The compensation mass member and the securing element are connected by a connecting rod arrangement with a scissor-type movement. The connecting rod arrangement is comprised of two connecting rods and a journal point at the housing. Due to the connecting rod arrangement, the compensation mass member and the securing element move in opposite directions relative to one another.

21 Claims, 6 Drawing Sheets

SHOCK-PROOF SAFETY BELT BUCKLE

BACKGROUND OF THE INVENTION

The present invention relates to a safety belt buckle for receiving and locking an insertion tongue, the safety belt buckle comprising a housing with an insertion path that contains a spring-loaded ejector. A latch is connected to the housing and cooperates with a cutout of the insertion tongue and a recess of the housing in the locking position. A slide key which is guided transverse to a plane of movement of the latch is provided for releasing the latch from its locking position. A securing element secures the latch in its locking position and is displaceably arranged within the housing so that it can be moved into a release position for the latch by the slide key. Furthermore, a compensation mass member is provided within the housing and is slidable for compensating acceleration forces acting on the safety belt buckle.

A safety belt buckle of the aforementioned kind is disclosed in German Offenlegungsschrift 35 33 684. When acceleration forces act on this device, the danger exits that the slide key is inserted in the release direction of the latch, which is arranged in a self-opening manner, activating the securing element which forces the latch into its locking position. Therefore, in the known safety belt buckle a compensation mass member is supported in a movable and spring-loaded manner, whereby the mass of the compensation mass member corresponds to the mass of the slide key so that the compensation mass member is able to compensate acceleration forces acting on the slide key.

However, the aforementioned safety belt buckle has the disadvantage that the compensation mass member essentially acts on the slide key and thus secures the securing element only in an indirect manner against opening movements. The design of the safety belt buckle and the arrangement of the compensation mass member are complicated and expensive, and furthermore, it is difficult to adjust the threshold for the activation of the compensation mass with respect to the required compensating force.

It is therefore an object of the present invention to simplify the design of the aforementioned safety belt buckle with respect to the arrangement of the compensation mass member and to directly improve the securing effect of the securing element during shock-like loads of the safety belt buckle.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1A:
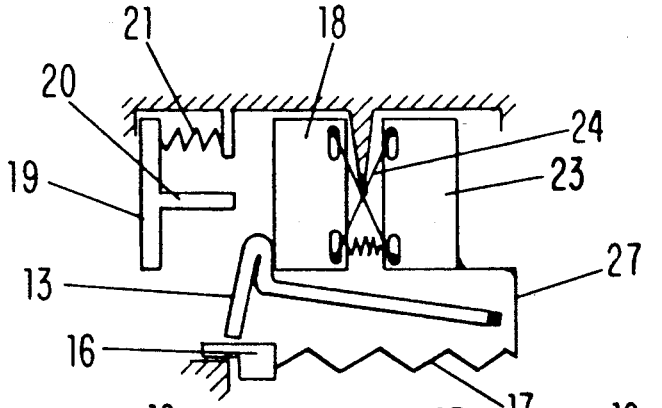
FIGS. 1*a–d* schematically represent the different stages of movement of the safety belt buckle during various loads.

The safety belt buckle of the present invention is primarily characterized by a housing comprising an insertion path, a spring-loaded ejector connected to the spring housing within the insertion path and further comprising a recess communicating with the insertion path; an insertion tongue having a cutout and insertable into the insertion path; a latch connected inside the housing for locking the insertion tongue by engaging the cutout and the recess of the housing in a locking position of the latch; a spring-loaded slide key, slidably connected to the housing and slidable in a direction transverse to a plan of movement of the latch for releasing the latch; a compensation mass member displaceably arranged within the housing for compensating acceleration forces acting on the safety belt buckle in two directions; a securing element displaceably arranged within the housing such that the securing element secures the latch in the locking position and is movable into a release position by the slide key for releasing the latch; and a connecting rod arrangement with a scissor-type movement, the connecting rod arrangement comprising two connecting rods and a journal means, the connecting rods being pivotably connected to the journal means and the journal means being connected to the housing, the connecting rod arrangement being further connected to the compensation mass member and the securing element such that the compensation mass member and the securing element move in opposite directions relative to one another.

It is the gist of the present invention that the compensation mass member is connected to the securing element via a scissor-type connecting rod arrangement having two connecting rods that are guided at a journal means connected to the housing so that the connecting rod arrangement forces the compensation mass member and the securing element to move in opposite directions relative to one another. This is advantageous because this forced guidance in opposite directions, when the safety belt buckle is exposed to acceleration forces acting on the two components, results in the neutralization of those acceleration forces so that in any load situation the securing element remains in its position for securing the latch. Due to the simple arrangement and connection of the securing element and the compensation mass member, the construction of the safety belt buckle is simplified at the same time.

In a preferred embodiment of the present invention, the connecting rods are inflexible and are guided at the journal means, whereby the compensation mass member and the securing element have slotted holes and the connecting rods are connected to these slotted holes. In this manner a relative movement of the securing element and the compensation mass member is possible. As an alternative, a fixed connection of the connecting rods to the securing element and/or the compensation mass member may be provided when the respective connecting rods have elastic properties.

In a further embodiment of the present invention, the safety belt buckle further comprises an ejector spring connected to the ejector for spring-loading the ejector, whereby the ejector spring abuts at the compensation mass member. It is expedient that the compensation mass member comprises a projection extending into the insertion path, whereby the projection serves as the abutment for the ejector spring. This is advantageous because the inserted insertion tongue, which loads the ejector spring, together with the ejector spring increase the closing force on the securing member via the compensation mass member so that the securing effect of the securing element under shock conditions is improved.

It is furthermore advantageous to provide a pressure spring connected between the compensation mass member and the securing element for pressing the compensation mass member and the securing element away from one another. This embodiment assists the elastic support effect of the ejector spring.

In order to simplify the construction of the safety belt buckle, the mass of the securing element and the mass of the compensation mass member may be of the same magnitude.

In one realization of the present invention the compression spring for spring-loading the slide key may be directly connected to the slide key. Thereby a comparatively simple constructive embodiment of the safety belt buckle is provided. As an alternative, it may also be provided that the compression spring of the slide key rests at a projecting abutment of the housing. In comparison to the first alternative this embodiment provides a more favorable force distribution.

In embodiments of the present invention in which the compression spring of the slide key rests directly at the securing element, it is advantageous in a further development of the present invention that the slide key, the compression spring, the securing element, the connecting rods, the compensation mass member, the ejector, and the ejector spring are formed as one single component. In view of the modern plastic processing technologies it does not present a problem to combine inflexible and elastic elements with one another in one component. Such an embodiment is especially advantageous because a very simple construction of the safety belt buckle results, and the assembly of the safety belt buckle is facilitated.

It is expedient that with the aforementioned embodiments the safety belt buckle further comprises spring legs and thin connecting straps for connecting the compensation mass member to the connecting rods and the securing element to the connecting rods. The spring legs and the thin connecting straps force the compensation mass member and the securing element away from one another, thus providing an additional elastic pushing force between the compensation mass member and the securing element.

In another embodiment of the present invention, the connecting rods have a portion between the journal means and the compensation mass member that is elastic, and the housing has a slotted hole to which the journal means is connected to be slidable in a longitudinal direction of the slotted hole. The compensation mass member in this embodiment is slidable in the 1 two directions of acceleration forces acting on the safety belt buckle.

In a further embodiment of the present invention the connecting rod arrangement is arranged between the compensation mass member on the one hand and the slide key and the securing element on the other hand so that the compensation mass member, depending on the two directions of the acceleration forces acting on the safety belt buckle, holds the slide key and the securing element in position. In this embodiment, the securing element is pivotably supported at the housing and the connecting rods have a portion between the journal means and the securing element extending to the slide key, whereby this portion has a pocket and the securing element is connected with one end thereof to the pocket in a form-locking manner. Due to this embodiment and arrangement, the securing element, when exposed to acceleration forces in the tightening direction of the safety belt buckle, develops an opening force so that, with respect to a portion of the mass of the securing member, it needs support by the compensation mass member. Since in this embodiment the slide key acts on the pivotable securing element, it is possible to provide the portions of the connecting rods between the journal means and the slide key with springs for supporting the slide key so that, when respective deceleration forces occur, the slide key is supported at these springs and is thus braked. With this arrangement, a separate compression spring for the slide key for its actuation is no longer required.

In another embodiment of the present invention the housing is U-shaped and further comprises a cross-piece, whereby the journal means is in the form of a trunnion arranged in a bore of the cross-piece. The cross-piece, the connecting rod arrangement, the trunnion, and the compensation mass member are preferably formed as one single component. This arrangement advantageously provides the option to embody the safety belt buckle with or without a shock-absorbing component because this shock-absorbing component is functionally separate from the latching or locking mechanism. Accordingly, the components of the safety belt buckle remain unchanged.

It is expedient that the connecting rods have a portion between the journal means and the securing element extending to the slide key, whereby the portion has a pocket and the securing element is connected with one end thereof to the pocket in a form-locking manner. Thus, when the scissor-type connecting rod arrangement is moved, the desired forced guidance of the securing element results.

Due to the cooperation of the compensation mass member and the slide key in the respective movement direction of the two aforementioned parts, the mass of the compensation mass member on the one hand and of the slide key with securing element on the other hand are of the same magnitude.

It is advantageous that the connecting rods have a portion between the journal means and the compensation mass member that is elastic, whereby the housing has a slotted hole to which the journal means is connected to be slidable in a longitudinal direction of the slotted hole and whereby the compensation mass member is slidable in the two directions of the acceleration forces acting on the safety belt buckle. In this embodiment the shock absorption of the safety belt buckle with respect to acceleration forces is achieved by the movement of the compensation mass member and the resulting tension and displacement of the scissor-type connecting rod arrangement, especially in connection with the elastic connecting rods which are supported in a resilient manner at the compensation mass member.

It is furthermore expedient that the latch has a catch and elastically deformable locking surfaces arranged on both sides of the catch in a longitudinal direction of the catch, whereby the securing element rests on the locking surfaces so that, in the release position, the securing element is spaced from the catch.

This arrangement has the advantage that only under stress a fixed connection between the securing element and the latch exists. Since without a stress load the securing element only rests at the elastically deformable locking surfaces, the opening forces of the safety belt buckle for moving the securing element are correspondingly reduced. When a stress load occurs, the locking surfaces will deform elastically so that the securing element comes into contact with the catch. As soon as the stress load subsides, the locking surfaces will resume their initial position so that the safety belt buckle may be opened easily.

Preferably, the catch is formed as a bent portion with a curved transition whereby the securing element rests at that curved transition. This arrangement is advantageous because during the release action of the securing element it must not be guided over the curved transition since this might result in malfunctioning of the safety belt buckle.

DESCRIPTION OF PREFERRED EMBODIMENTS

The present invention will now be described in detail with the aid of several specific embodiments utilizing FIGS. 1 through 10. With the aid of the schematic representations of the safety belt buckle in FIGS. 1*a* to 1*d*, the present invention will first be explained with respect to the fundamental cooperation of the components of the safety belt buckle.

Figure 1B:
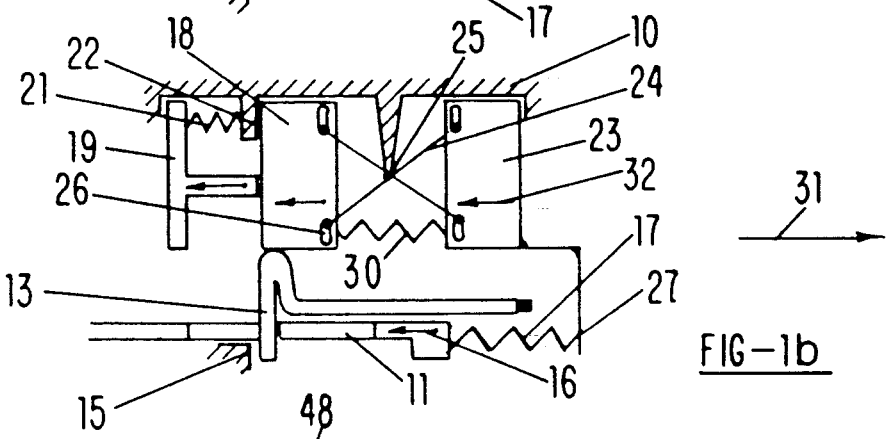
Figure 1C:
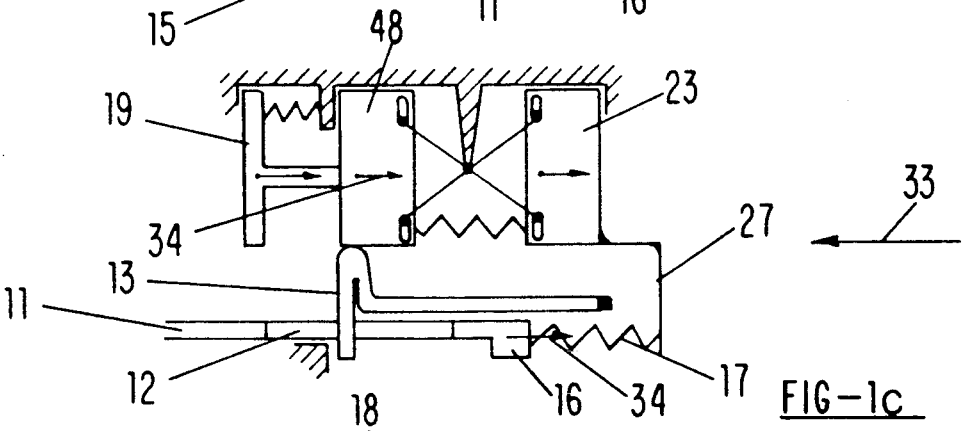

An insertion tongue 11 having a cutout 12 is insertable into an insertion path of a housing 10 and may be locked in the housing by a pivotably supported latch 13 (FIGS. 1*b*, 1*c*). The latch engages an opening 14 at a base plate 15 of the housing 10. Within the insertion path for the insertion tongue 11, an ejector 16 is arranged in a slidable manner which is prestressed by an ejector spring 17.

The latch 13 is pivotably supported at the housing 10 in a self-opening manner and is held in a locking position by a securing element 18 that is slidably arranged within the housing 10 (FIG. 1*b*). A projection 20 of the slide key 19 acts on the securing element 18 and displaces it upon actuation of the slide key 19 out of its locking position so that the latch 13 is released into a release position. The slide key 19 is loaded into its initial position by a compression spring 21 which is supported at a projecting abutment 22 of the housing 10. As an alternative, it may be provided that the compression spring 21 is directly supported at the securing element 18.

A compensation mass member 23 is slidably arranged within the housing 10 and is connected via two connecting rods 24, arranged in a scissor-type arrangement, to the securing element 18. The crossing point of the two connecting rods 24 is in the form of a journal means or pivoting point 25 connected to the housing. The coupling of tee connecting rods 24 to the securing element 18 on the one hand and to the compensation mass member 23 on the other hand is achieved by providing slotted holes 26 within the components 18, 23 so that a relative movement of the components 18, 23 is possible. Alternatively, the connection between the connecting rods 24 with either the securing element 18 or the compensation mass member 23 or with both aforementioned components may also be a fixed connection, i.e., without slotted holes, as long as the portions of the connecting rods 24 have elastic properties. In the embodiment shown in the drawings FIGS. 1*a* to 1*d* a pressure spring 30 is disposed between the securing element 18 and the compensation mass member 23 which acts to push the parts 18, 23 away from one another in order to space the two components from one another.

The compensation mass member 23 is further provided with a projection 27 which extends into the insertion path for the insertion tongue 11 and which serves as an abutment for the ejector spring 17 so that the spring force resulting from the stressed ejector spring 17 acts via the projection 27, the compensation mass member 23, and the connecting rods 24 on the securing element 18.

FIG. 1*a* shows the initial position of the safety belt buckle with the insertion tongue 11 not yet inserted. The latch 13 is pivoted in an upward direction and rests on the ejector 16. The securing element 18 is in its release position.

FIG. 1*b* shows the position of the components of the safety belt buckle with the insertion tongue 11 inserted into the housing. The latch 13 penetrates the cutout 12 of the insertion tongue 11 and engages the recess 14 of the base plate 15 of the housing 10 so that the insertion tongue 11 is looked at the housing 10. In this position, the securing element 18 is moved into its forward position and rests at the latch 13 thereby preventing it from assuming its release position. Due to the inserted insertion tongue 11, the ejector 16 is in its backward position and the ejector spring 17 is accordingly prestressed. Via the abutment in the form of the projection 27 of the compensation mass member 23 as well as via the connecting rods 24, the securing element 18 is loaded into the shown locking position and accordingly provides a closing force.

When in this locked position of the safety belt buckle, the safety belt buckle is accelerated in the direction of the arrow 31, for example, when the safety belt is tightened, then the inertia forces, indicated in the form of arrows 32, of the compensation mass member 23, the securing element 18 and the slide key 19 act such that a self-opening of the safety belt buckle is prevented because the securing element 18 is additionally loaded by the inertia forces into its securing position.

FIG. 1*c* shows the situation in which at the end of a tightening step, when the safety belt buckle housing 10 is in its end position and an acceleration occurs in the direction of the arrow 33 (the mass moments of inertia of the slide key 19 and the securing element 18 are represented by the arrows 34), the slide key 19 is inserted into the housing 10 and supports the initiated opening movement of the securing element 18.

However, the movement of the compensation mass member 23, which occurs also in the direction of the arrow 34, counters the aforementioned opening movement because, due to the identical mass of compensation mass member 23 versus securing element 18 and sliding key 19 and their inventive connection in form of the scissor-type connecting rod arrangement, a movement of the securing element 18 relative to the compensation mass member 23 cannot take place so that the acceleration forces are compensated and a displacement of the securing element 18 may not take place.

Not taken into consideration is the mass of the slide key 19 onto which also a force in the direction of the arrow 34 is acting. This force, however, may only become effective after overcoming the compression spring 21 and the remaining force component must be greater than the counter force exerted onto the securing element 18 by the compensation mass member 23 which counter force is additionally reinforced by the spring force of the stress ejector spring 17 when a displacement of the securing element 18 is effected by the slide key 19. Due to a respective dimensioning of the slide key mass, the compression spring and the ejector spring, the opening movement of the slide key may be prevented.

Figure 1D:
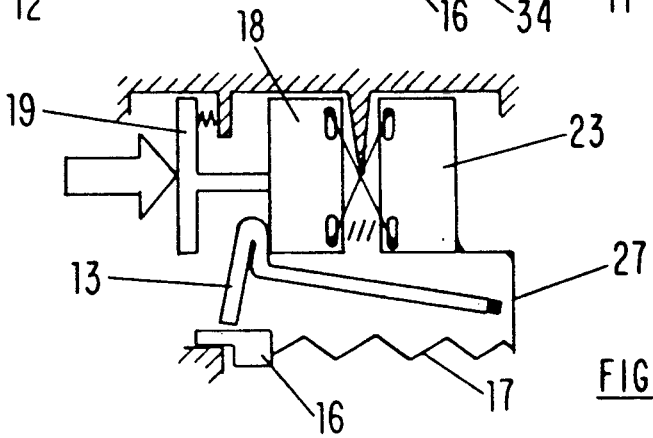

FIG. 1*d* demonstrates the opening step of the safety belt buckle due to the actuation of the slide key 19 which moves the securing element 18 from its securing position so that the latch 13 is released from the cutout 12 of the insertion tongue 11.

Figure 2:
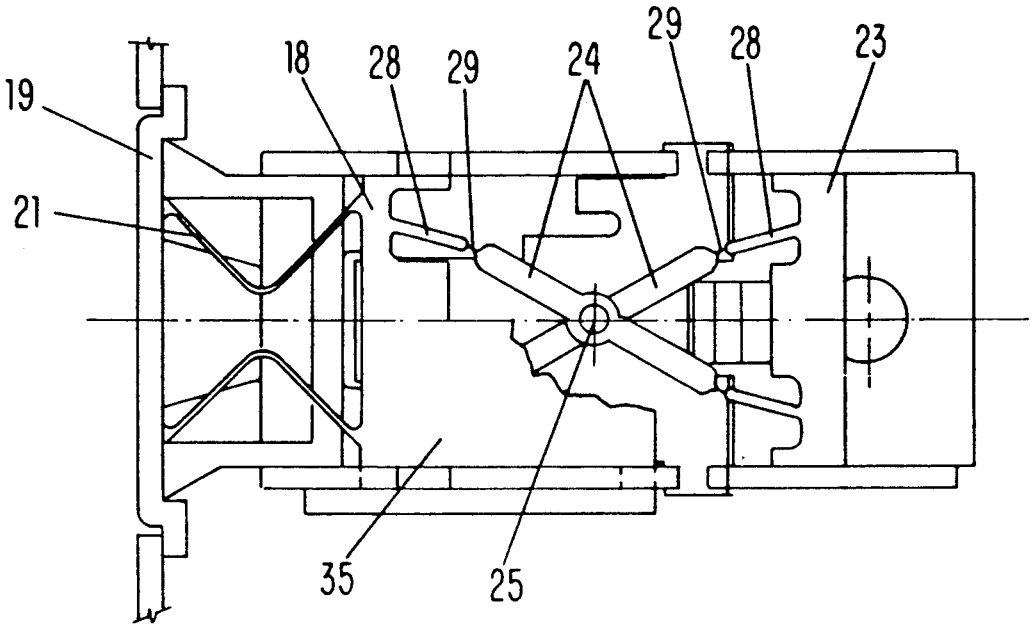
FIG. 2 shows an embodiment of the present invention in a plan view.
Figure 3:
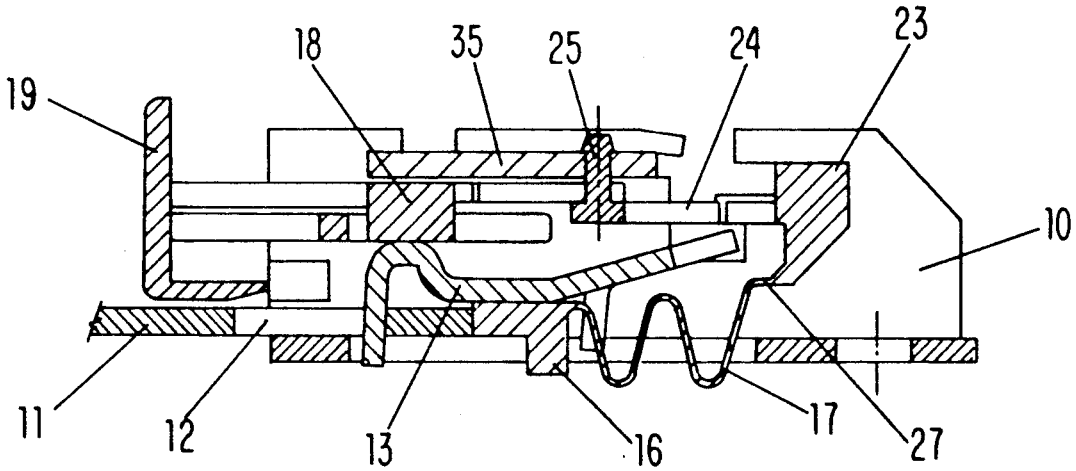
FIG. 3 shows the embodiment according to FIG. 2 in a side view.

FIGS. 2 and 3 represent an embodiment of the present invention in conformity with the schematic representation of FIGS. 1*a* to *d*,, whereby identical components and parts have the same reference numerals. From the drawings it can first be taken that the U-shaped safety belt buckle housing 10 is closed at its upper side by a plate 35. Furthermore, the connecting rods 24 are connected via intermediate spring legs 28 and thin connection straps 29 coordinated therewith to the securing element 18, respectively, the compensation mass member 23. The spring legs 28 and the thin connection straps 29 represent an alternative to the spring 30 in the embodiment according to FIGS. 1*a* to *d* for pushing the securing element 18 and the compensation mass member 23 away from one another. The embodiment of FIGS. 2 and 3 functions in the same manner as described above for the schematic representation of FIGS. 1*a* to *d*.

Figure 4:
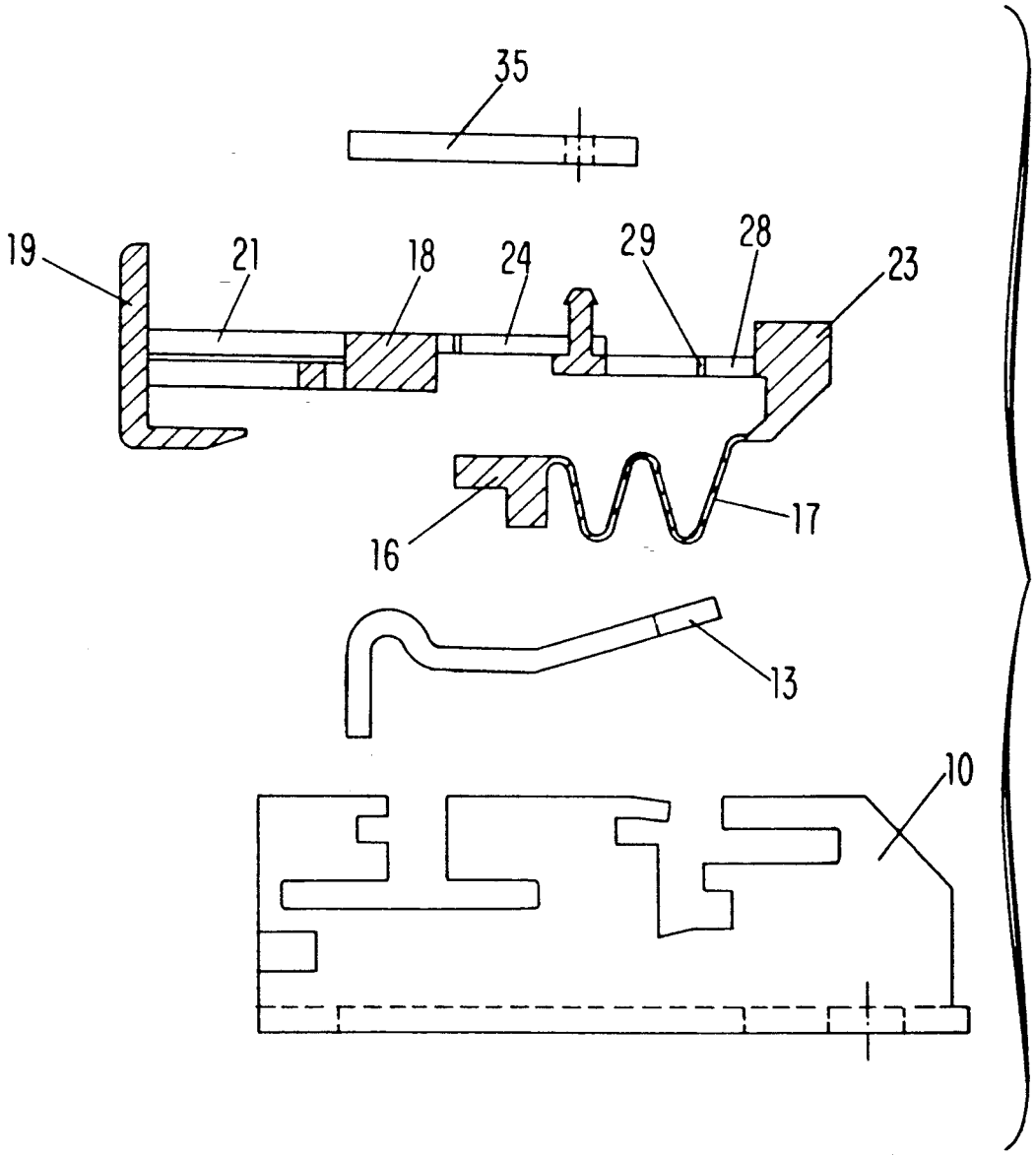
FIG. 4 shows components of the safety belt buckle according to FIGS. 2 and 3 in an exploded view.

FIG. 4 shows an embodiment of the present invention in which, corresponding to the embodiment of FIGS. 2 and 3, the slide key 19, the compression spring 21, the securing element 18, the connecting rods 24, the compensation mass member 23, the ejector spring 17, and the ejector 16 are in the form of a single component which is preferably manufactured from plastic material. The incorporation of inflexible and flexible parts in one single component does not present any problems in view of the modern plastic manufacturing technologies so that it can be taken from FIG. 4 that in an advantageous manner the safety belt buckle is comprised of only a few components which are easily assembled.

The embodiments represented in FIGS. 5 to 10 correspond in their basic construction to the safety belt buckle described with the aid of FIGS. 1 to 4. In the embodiments according to FIGS. 5 to 10, the securing element 40 is pivotably supported at the housing 10 such that it secures the latch 13 with its front face. Accordingly, the securing element 40 is located above the curved transition 42 of the catch 41 provided at the latch 13 for engaging the cutout 12 of the insertion tongue 11, whereby the latch 13 on both sides, viewed in the longitudinal direction of the latch, is provided with elastically deformable locking surfaces 43 on which the securing element 40 rests with its front face. Thus, the securing element 40 is spaced from the catch 41 in the locking position of the safety belt buckle. This embodiment serves to reduce the opening forces with respect to the movement of the securing element.

In the embodiment according to FIGS. 5 to 10 the scissor-type connecting rod arrangement at a cross-piece 45 which is placed onto the U-shaped housing 10. The cross-piece 45 is provided with a bore, respectively, a slotted hole 46 for receiving a trunnion 47 representing the journal means of the connecting rod arrangement. The connecting rods 48 extending between the trunnion 47 and the compensation mass member 23 are elastic and are supported in corresponding pockets 49 of the compensation mass member 23. The connecting rod 50 extending between the trunnion 47 and the slide key 19 have springs 51 for loading the slide key 19. The connection of the connecting rod arrangement with the securing element 40 is accomplished in the represented embodiment with pockets 52 that are slipped over the securing element 40 and are guided at the connecting rods 50. The upper edge 53 of the securing element 40 is movable within these pockets 52 when the securing element 40 is pivoted.

Figure 6:
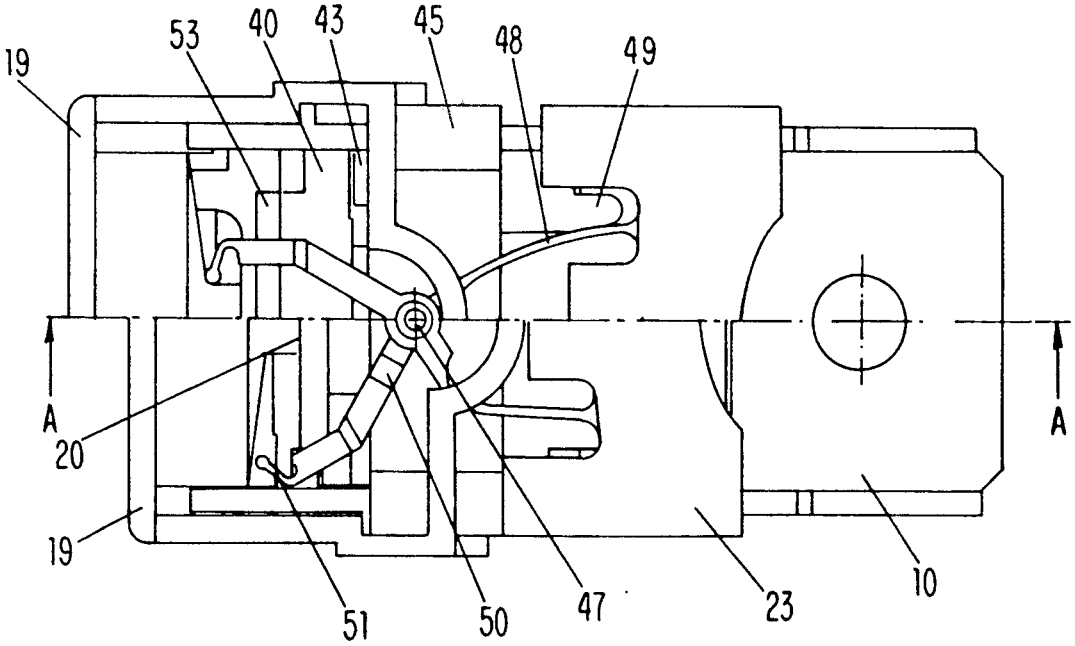
FIG. 6 shows another embodiment of the safety belt buckle of the present invention in a plan view whereby the upper half of the drawing corresponds to the locking position of the safety belt buckle and the lower half of the drawing shows the release position of the safety belt buckle with the slide key being pressed inwardly.
Figure 7:
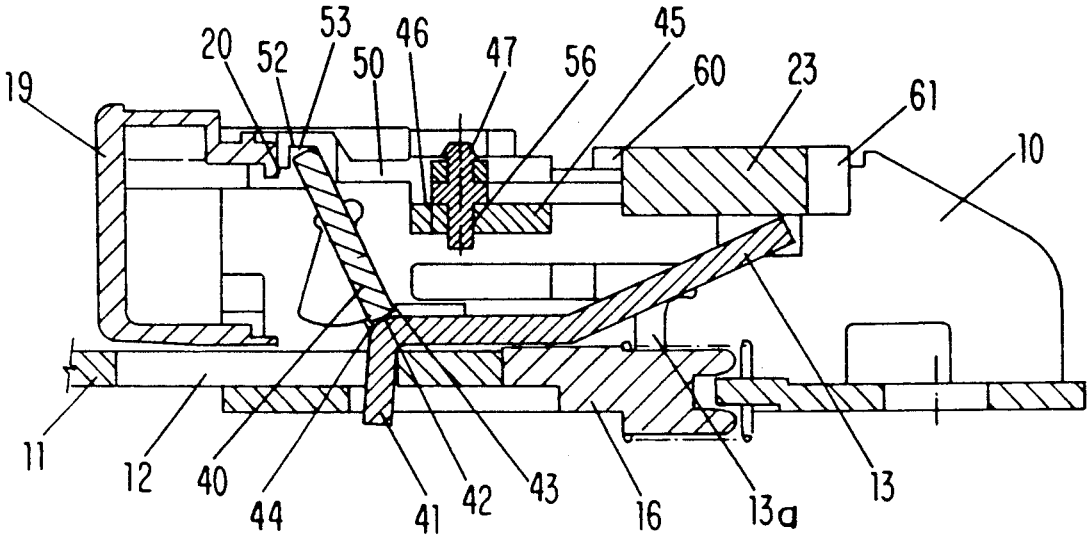
FIG. 7 shows the safety belt buckle according to FIG. 5 in a view along the line A—A of FIG. 6.
Figure 8:
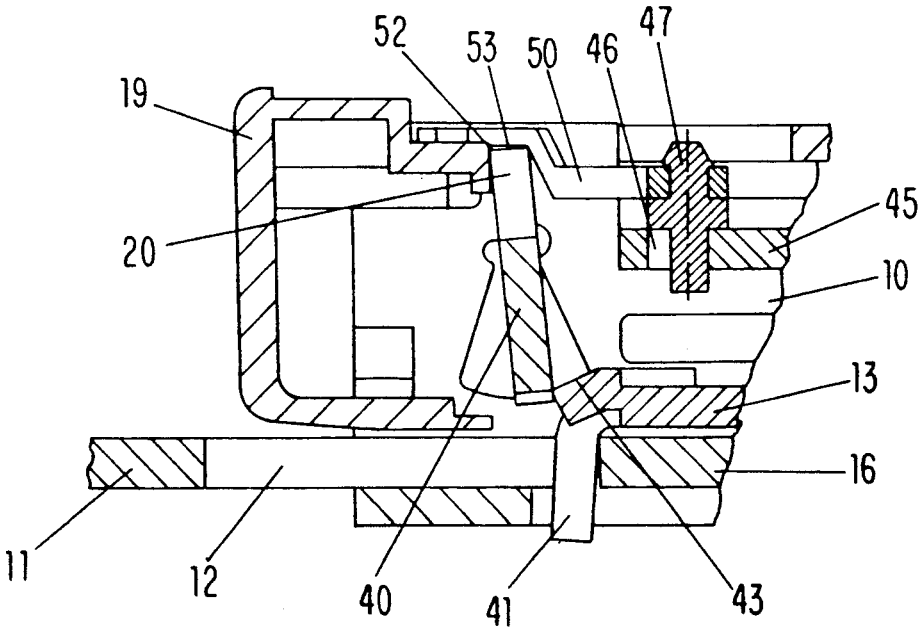
FIG. 8 shows the safety belt buckle in its release position in a representation corresponding to FIG. 10.

The safety belt buckle is operated such that the insertion tongue 11 is inserted into the insertion path of the housing 10 and thereby presses the ejector 16 against the force of the ejector spring 17 into a rearward position against two downwardly extending ends 13*a* of the latch 13 so that the latch 13 with its catch 41 is pushed into the cutout 12 of the insertion tongue 11. Due to this pivoting movement the securing element 40 is activated. In the released position of the safety belt buckle, the connecting rods 48 are prestressed by the compensation mass member 23 and are now pressing, due to the scissor-type arrangement, the securing element 40 onto the locking surfaces 43 of the latch 13 via the connecting rod 50 and the pocket 52 to thereby lock the latch 13 in its locking position. The actuation of the connecting rods 48, 50 also moves the integrally formed springs 51 at the ends of the connecting rods 50 toward the slide key 19 and holds the slide key 19 in its forward position (FIGS. 6, 7).

In the locking position, the securing element 40 rests at the lateral locking surfaces 43 of the latch 13. In the area of the curved transition 42 of the catch 41, however, a distance 44 is present between the latch 13 and the securing element 40. Upon a stress load, the locking surfaces 43 are elastically deformed such that the load is transmitted via the curved transition 42 onto the securing element 40. When this stress load subsides, the locking surfaces 43 resume their initial position so that the safety belt buckle may be easily opened.

In order to release the safety belt buckle, the slide key 19 is inserted into the housing 10 so that thereby initially the springs 51 of the connecting rods 50 are deformed until the projection 20 of the slide key 19 abut against the securing element 40. Upon further insertion, the securing element 40 is pivoted out of its securing position and simultaneously also stresses, via the connection of the pocket 52 and the connecting rods 50, the connecting rods 48 against the compensation mass member 23. The compensation mass member 23, in the embodiment having a slotted hole, moves toward a corresponding abutment; accordingly, the opening forces are smaller than in the embodiment without a slotted hole. When the securing element 40 is pivoted over the edge of the locking surfaces 43, the latch 13 and thus the insertion tongue 11 is released.

Figure 5:
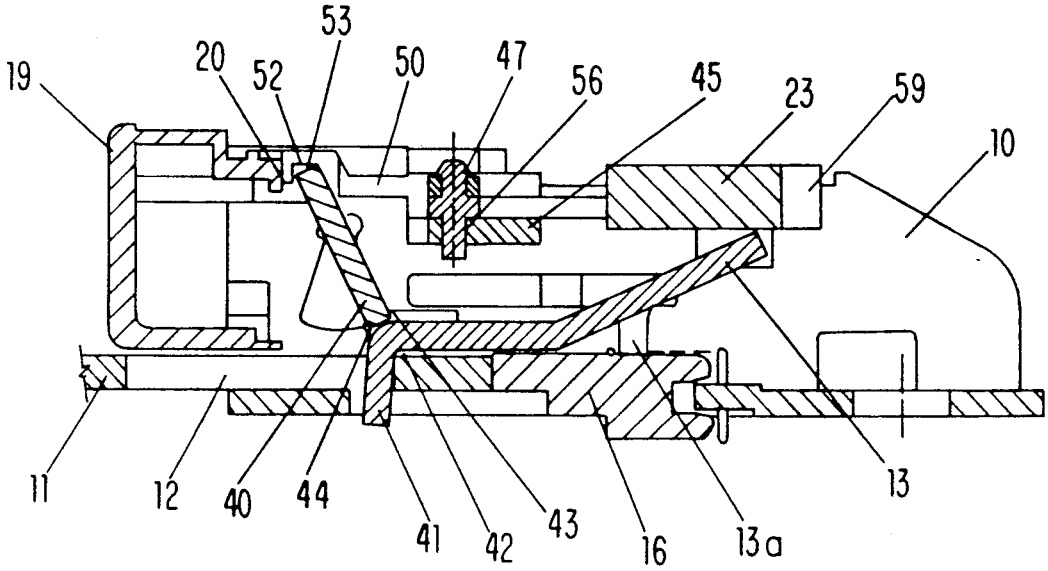
FIG. 5 shows another embodiment of the inventive safety belt buckle in a longitudinal cross-section.

In the embodiment according to FIG. 5, the trunnion 47 is fixedly connected to the cross-piece 45, and the compensation mass member 22 is movable within a respective recess 59 of the housing from its forward position, represented in FIG. 5, into a rearward position whereby the scissor-type connecting rod arrangement with the connecting rods 48, 50 is pulled together, i.e., closed. In the embodiment according to FIGS. 6 to 10, the compensation mass member 23 is movable from its initial position, represented in FIG. 7, into a forward position into the opening 60 as well as into a rearward position into the opening 61. The description of the function of the shock absorbtion is based on the representation of the embodiments of the FIGS. 6 through 10 whereby the difference with respect to the function of the embodiment of FIG. 5 will be taken into account.

Figure 9:
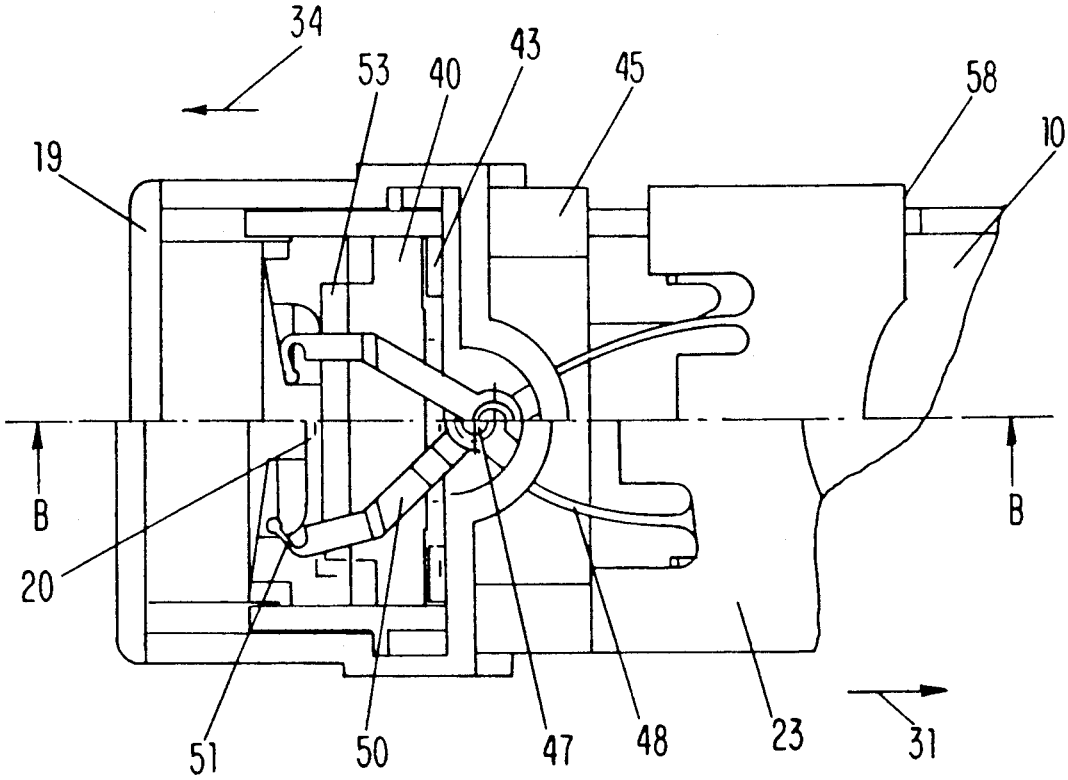
FIG. 9 shows the belt buckle in a plan view, whereby the upper half of the drawing shows the safety belt buckle exposed to acceleration forces against the tightening direction and the lower half of the drawing shows the safety belt buckle exposed to acceleration forces in the tightening direction.
Figure 10:
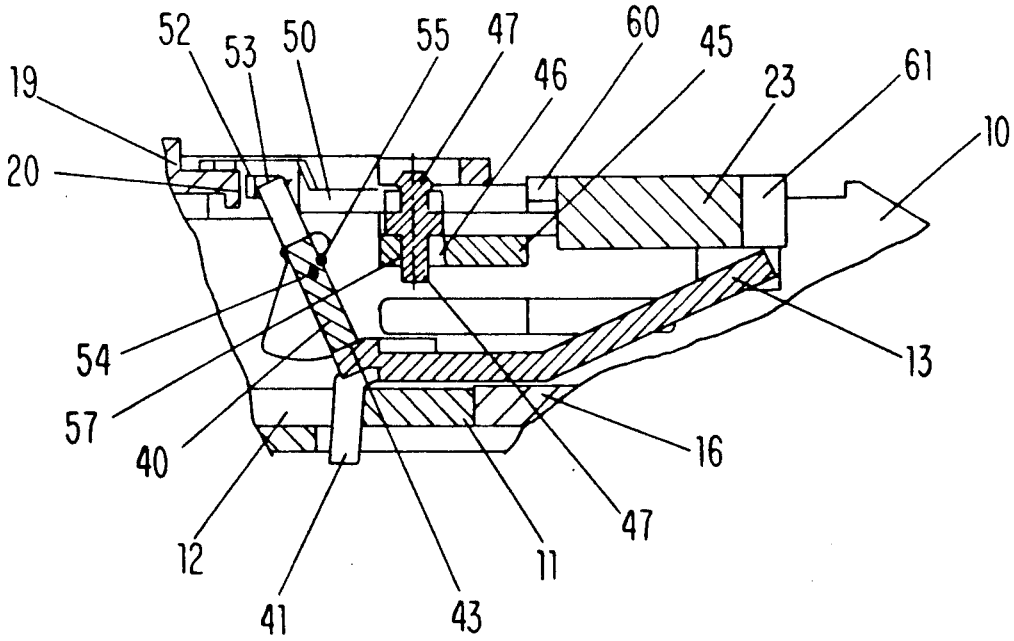
FIG. 10 shows the safety belt buckle according to FIG. 9 in a view along the line B—B of FIG. 9.

When a tightening movement of the safety belt accelerated in the direction of arrow 31 (FIG. 9). During this acceleration, the sliding key 19 remains in its position due to its mass inertia and does not move relative to the surrounding arrangement. The securing element 40 has it center of gravity 54 below its pivoting point 55 (FIG. 10) so that, when an acceleration in the direction of arrow 31 occurs, an opening force for the latch 13 results. In the embodiment according to FIG. 5, the compensation mass member 23 is fixed in its forward position and remains in this position due to its inertia and thus counters via the support by the connecting rods 48, 50 the opening movement of the securing element 40. With a sufficient spring tension of the connecting rod 48, the compensation mass member 23 thus supports the securing element 40 in its securing position. In the embodiment shown in FIGS. 6 to 10, the compensation mass member 23 moves in the direction of arrow 34 into the forward opening 60 whereby simultaneously the trunnion 47 is moved from its rearward position 56 into the forward position 57 within the slotted hole 46 of the cross-piece 45 (FIG. 10). These action cause the elastic connecting rods 50 to be tensioned and the shock absorbing unit counteracts the opening forces of the securing element 40.

After the tightening step has been completed, the safety belt buckle is exposed to an acceleration in the direction of arrow 34 and, accordingly, the slide key 19 is moved into the opening direction due to its inertia. First, the slide key is braked by the springs 51 before the projection 20 of the slide key abuts against the securing element 40. Simultaneously, the trunnion 47 of the connecting rod 48, 50 is moved into a rearward position 56, within the slotted hole 46, and the compensation mass member 23, which has a greater mass than the slide key 19 with the corresponding mass portion of the securing element 40, is moved into the rearward locking position 58 and closes the scissor-type connecting rod arrangement of the connecting rods 48, 50. Accordingly, the slide key 19, together with the force of the securing element 40 acting in the direction of acceleration (arrow 34), is prevented from a further movement in the opening direction so that the safety belt buckle remains in its locked position.

The present invention is, of course, in no way restricted to the specific disclosure of the specification and drawings, but also encompasses any modifications within the scope of the appended claims.

What we claim is:

1. A safety belt buckle, comprising:

a housing comprising: an insertion path, a spring-loaded ejector connected to said spring housing within said insertion path, and comprising a recess communicating with said insertion path;

an insertion tongue having a cutout and insertable into said insertion path;

a latch connected inside said housing for locking said insertion tongue by engaging said cutout and said recess of said housing in a locking position of said latch;

a spring-loaded slide key, slidably connected to said housing and slidable in a direction transverse to a plane of movement of said latch for releasing said latch;

a compensation mass member displaceably arranged within said housing for compensating acceleration forces acting on said safety belt buckle in two directions;

a securing element displaceably arranged within said housing such that said securing element secures said latch in said locking position and is movable into a release position by said slide key for releasing said latch; and a connecting rod arrangement with a scissor-type movement, said connecting rod arrangement comprising two connecting rods and a journal means, said connecting rods being pivotably connected to said journal means and said journal means being connected to said housing, said connecting rod arrangement being further connected to said compensation mass member and said securing element such that said compensation mass member and said securing element move in opposite directions relative to one another.

2. A safety belt buckle according to claim 1, wherein said connecting rods are inflexible and are guided at said journal means, and wherein said compensation mass member and said securing element have slotted holes, with said connecting rods being connected to said slotted holes.

3. A safety belt buckle according to claim 1, wherein said connecting rods have elastic properties.

4. A safety belt buckle according to claim 1, further comprising an ejector spring connected to said ejector for spring-loading said ejector, said ejector spring abutting at said compensation mass member.

5. A safety belt buckle according to claim 4, wherein said compensation mass member comprises a projection extending into said insertion path, said projection serving as an abutment for said ejector spring.

6. A safety belt buckle according to claim 1, further comprising a pressure spring connected between said compensation mass member and said securing element for pressing said compensation mass member and said securing element away from one another.

7. A safety belt buckle according to claim 1, wherein a mass of said securing element and the mass of said compensation mass member are of the same magnitude.

8. A safety belt buckle according to claim 1, further comprising a compression spring for spring-loading said slide key, said compression spring being directly connected to said securing element.

9. A safety belt buckle according to claim 8, wherein said housing comprises a projecting abutment at which said compression spring abuts.

10. A safety belt buckle according to claim 8, further comprising an ejector spring connected to said ejector for spring-loading said ejector, said ejector spring abutting at said compensation mass member, and wherein said slide key, said compression spring, said securing element, said connecting rods, said compensation mass member, said ejector, and said ejector spring are formed as one single component.

11. A safety belt buckle according to claim 10, further comprising spring legs and thin connecting straps for connecting said compensation mass member to said connecting rods and said securing element to said connecting rods, said spring legs and said thin connecting straps forcing said compensation mass member and said securing element away from one another.

12. A safety belt buckle according to claim 11, wherein said connecting rods have a portion between said journal means and said compensation mass member that is elastic, wherein said housing has a slotted hole to which said journal means is connected to be slidable in a longitudinal direction of said slotted hole, and wherein said compensation mass member is slidable in said two directions of the acceleration forces acting on said safety belt buckle.

13. A safety belt buckle according to claim 11, wherein the mass of said compensation mass member on the one hand and a mass of said slide key together with said securing element on the other hand are of the same magnitude.

14. A safety belt buckle according to claim 1, wherein said connecting rod arrangement is arranged between said compensation mass member on the one hand and said slide key and said securing element on the other hand so that said compensation mass member, depending on said two directions of the acceleration forces, acting on said safety belt buckle, maintains said slide key and said securing element in place.

15. A safety belt buckle according to claim 14, wherein said securing element is pivotably supported at said housing, and wherein said connecting rods have a portion between said journal means and said securing element extending to said slide key, said portion having a pocket and said securing element being connected with one end thereof to said pocket in a form-locking manner.

16. A safety belt buckle according to claim 15, wherein said portions of said connecting rods have springs for supporting said securing element.

17. A safety belt buckle according to claim 14, wherein said housing is U-shaped and further comprises a cross-piece, with said journal means being in the form of a trunnion connected to said cross-piece, with said cross-piece, said connecting rod arrangement, said trunnion and said compensation mass member being formed as one single component.

18. A safety belt buckle according to claim 14, wherein the mass of said compensation mass member on the one hand and a mass of said slide key together with said securing element on the other hand are of the same magnitude.

19. A safety belt buckle according to claim 14, wherein said connecting rods have a portion between said journal means and said compensation mass member that is elastic, wherein said housing has a slotted hole to which said journal means is connected to be slidable in a longitudinal direction of said slotted hole, and wherein said compensation mass member is slidable in said two directions of the acceleration forces acting on said safety belt buckle.

20. A safety belt buckle according to claim 19, wherein said catch is formed as a bent portion with a curved transition, with said securing element resting at said curved transition.

21. A safety belt buckle according to claim 14, wherein said latch has a catch and elastically deformable locking surfaces arranged on both sides of said catch in a longitudinal direction of said catch, with said securing element resting on said locking surfaces so that in said release position said securing element is spaced from said catch.

* * * * *

UNITED STATES PATENT AND TRADEMARK OFFICE

CERTIFICATE OF CORRECTION

PATENT NO. : 5,195,224

DATED : March 23, 1993

INVENTOR(S) : Bock et al

It is certified that error appears in the above-identified patent and that said Letters Patent is hereby corrected as shown below:

On the title page, after item [22] Filed: insert the following:

[30] Foreign Application Priority Data

Apr. 3, 1991 [DE] Fed. Rep. of Germany ..... 4110696

Signed and Sealed this

Ninth Day of November, 1993

Bruce Lehman

*Attest:*

BRUCE LEHMAN

*Attesting Officer*

*Commissioner of Patents and Trademarks*